US005566517A

United States Patent [19]

Ishii et al.

[11] Patent Number: 5,566,517

[45] Date of Patent: Oct. 22, 1996

[54] ARCHITECTURAL PANEL

[75] Inventors: Mikio Ishii; Shigeru Mori, both of Miyata-mura, Japan

[73] Assignee: Toyoexteria Kabushikikaisha, Tokyo, Japan

[21] Appl. No.: 364,475

[22] Filed: Dec. 27, 1994

[30] Foreign Application Priority Data

Sep. 10, 1994 [JP] Japan ..... 6-242297

[51] Int. Cl.[6] ..... F04B 2/00

[52] U.S. Cl. ..... 52/387; 52/439; 52/391; 52/592.1; 52/309.12

[58] Field of Search ..... 52/742.13, 748, 52/746.1, 747.1, 747.12, 503, 504, 505, 506.04, 387, 439, 309.11, 309.12, 391, 603, 604, 605, 592.1

[56] References Cited

U.S. PATENT DOCUMENTS

| | | | |
|---|---|---|---|
| 1,970,414 | 8/1934 | Brown | 52/505 X |
| 2,118,936 | 5/1938 | Malinouszky | 52/504 X |
| 3,449,876 | 6/1969 | Bloom | 52/742.13 X |
| 3,609,926 | 10/1971 | Holse | 52/503 X |
| 3,777,431 | 12/1973 | Bowman | 52/604 X |
| 3,864,885 | 2/1975 | Muse | 52/439 X |
| 4,522,003 | 6/1985 | Akihama et al. | 52/391 |
| 4,532,745 | 8/1985 | Kinard | 52/439 X |
| 4,631,890 | 12/1986 | Szombathelyi | 52/570 |
| 4,856,238 | 8/1989 | Kesting | 52/505 X |
| 4,944,127 | 7/1990 | Clear | 52/309.12 |
| 5,231,813 | 8/1993 | Drawdy | 52/309.12 |
| 5,351,454 | 10/1994 | Hahne et al. | 52/309.11 X |

FOREIGN PATENT DOCUMENTS

| | | |
|---|---|---|
| 1578821 | 8/1969 | France . |
| 2259195 | 8/1975 | France . |
| 2274752 | 1/1976 | France . |
| 3125938 | 1/1983 | Germany . |
| 22042 | 6/1994 | Japan . |
| 7016713 | 12/1971 | Netherlands . |
| 423170 | 10/1959 | Switzerland . |

*Primary Examiner*—Carl D. Friedman
*Assistant Examiner*—Winnie Yip
*Attorney, Agent, or Firm*—Nixon & Vanderhye P.C.

[57] ABSTRACT

A projection is formed on the back of the bed of an architectural panel used as a fence, a gate or a wall of a building, and a groove is formed in the same direction as the projection. The projection of one face member is fitted in the groove of another face member which makes a pair with the former face member. This prevents the projection from being broken during transportation or the like.

10 Claims, 8 Drawing Sheets

ARCHITECTURAL PANEL

BACKGROUND OF THE INVENTION

1. Field of the Invention

The present invention relates to architectural panels for building a fence, a gate or a building wall.

2. Description of the Related Art

A conventional fence is built by fixing and stacking concrete blocks side by side and one on another with readymixed concrete. It is however difficult to build fences having various appearances with such stacked blocks. To provide fences with various appearances, the structure as disclosed in, for example, Japanese Examined Utility Model Publication No. 22042/1994 may be employed. According to the structure disclosed in the publication, a groove is formed in the bed, such as a block, a projection or a weir-shaped projection is formed in the back of the face member, such as a tile, and the projection of the face member is fitted in and adhered to the groove of the bed, so that the face member is attached to the bed.

With the projection of the face member fitted in the groove of the bed, however, the projection of the face member may be broken during transportation. Particularly, to form a groove in the bed, constituted of an existing concrete block, by a concrete cutter, the groove should be made narrow (generally, about 3 mm). This requires that the projection should also be formed narrow, so that the projection becomes easier to break. Further, if a projection is formed in a brittle face member, it is easily broken when fitted in the groove in the bed. Similar problems arise when face members are attached to beds to construct the facing of a gate or the wall of a building.

SUMMARY OF THE INVENTION

Accordingly, it a primary object of the present invention to provide architectural panels, which are structured in such a way that face members, which are to be attached to beds to build the face of a gate or the wall of a building, permit the fence or gate to have various appearances, and that projections formed on the face members are unlikely to be broken during transportation or the like.

It is another object of this invention to provide an architectural panel which has an improved appearance and has an enhanced strength.

It is a different object of this invention to provide an architectural panel which has an improved appearance and has an enhanced strength.

It is a further object of this invention to provide an architectural panel which is easy to transport and handle, can relatively permit a size error between its groove and projection, and can facilitate temporal tacking at the time of construction.

It is a still further object of this invention to provide an architectural panel whose bed is supported on a support and is not therefore shifted.

Other objects of the present invention will become readily apparent from the following detailed description.

According to the present invention, there is provided an architectural panel having a face member with a groove or a projection fitted on or in a projection or a groove formed in a bed of a fence, a gate or a wall of a building, the face member having a projection formed on a back thereof and a groove formed in a same direction as the projection in such a way that the projection of the face member is fitted in a groove of another face member which makes a pair with the former face member. It is preferable that the face member has a base made of a foam member and a mixture of an incombustible powdery material and an incombustible adhesive is coated on the surface of the base of the face member to provide a stony finish. It is also preferable that the bed is made of a synthesized resin foam member. A through hole may be formed in the bed and a support of a fence may be made of an aluminum alloy extruded shape, whereby the through hole is fitted over the support to attach the bed to the support. Further, holes may be formed in the top and bottom of the bed and vertically adjoining beds may be coupled by a coupling member fitted in the holes in the adjoining beds.

The face member of this invention is attached to the bed by fitting the projection or groove provided on the back of the face member in or on the groove or projection of the bed and adhering those projection and groove. At the time of transportation or storage, the projection and groove of one face member are fitted in and on the groove and projection of another face member so that those projections are protected between two face members.

DETAILED DESCRIPTION OF THE PREFERRED EMBODIMENTS

Figure 2:
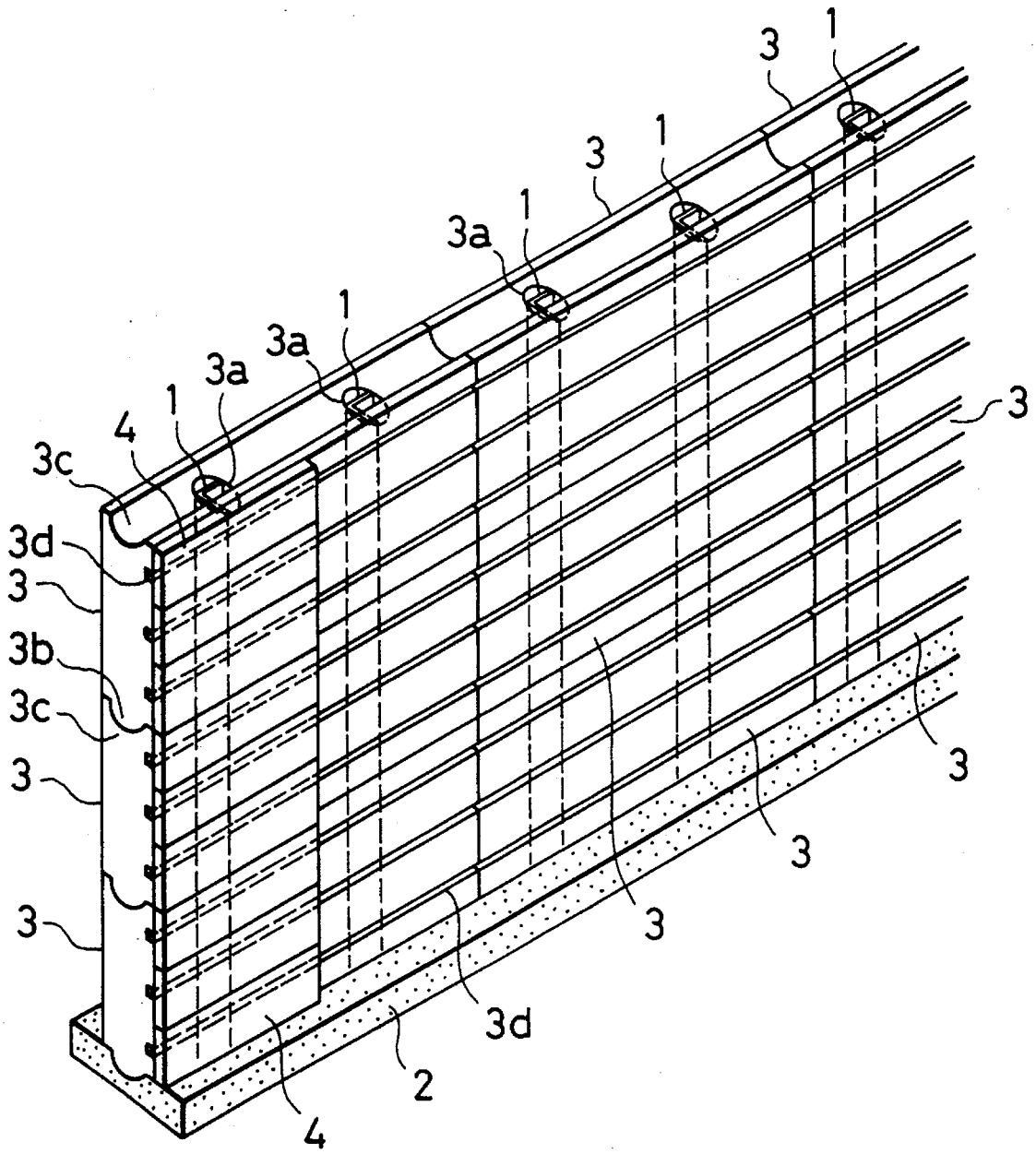
FIG. 2 is a perspective view showing one embodiment of this invention as adapted for a fence.
Figure 3:
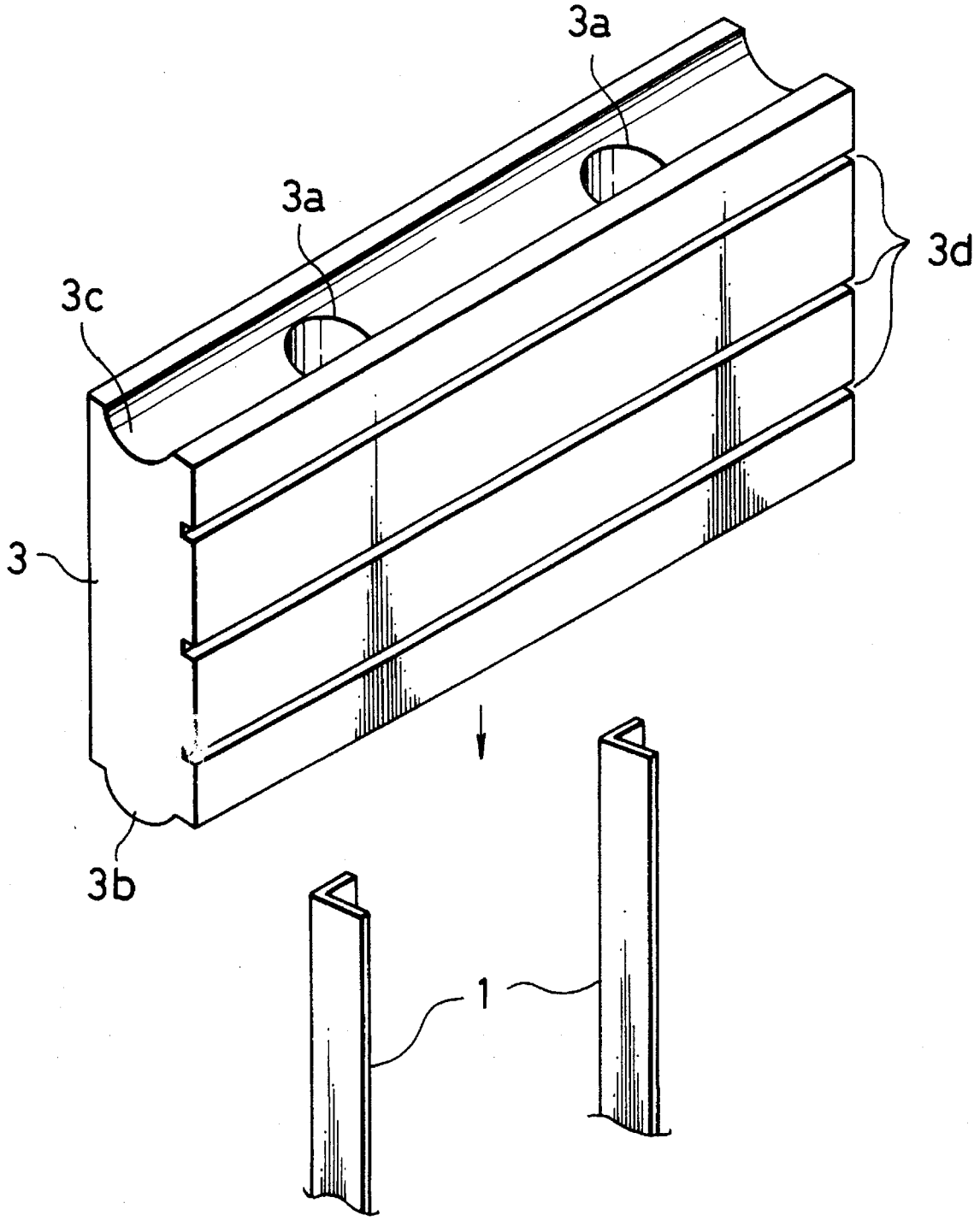
FIG. 3 is a perspective view showing one example of a bed according to this invention.

In FIG. 2, reference numeral "1" denotes a support made of an aluminum alloy extruded shape whose bottom end is buried in a concrete sill 2, reference numeral "3" denotes the bed of a fence, and reference numeral "4" denotes a face member. The bed 3 of this example is made of a synthesized foam member, and has a through hole 3*a* in the up and down direction, a projection 3*b* at the bottom and a recess 3*c* at the top. A groove 3*d* for attachment to the face member 4 is formed horizontally in one side of the bed 3 (it may be formed on both sides).

Figure 1A:
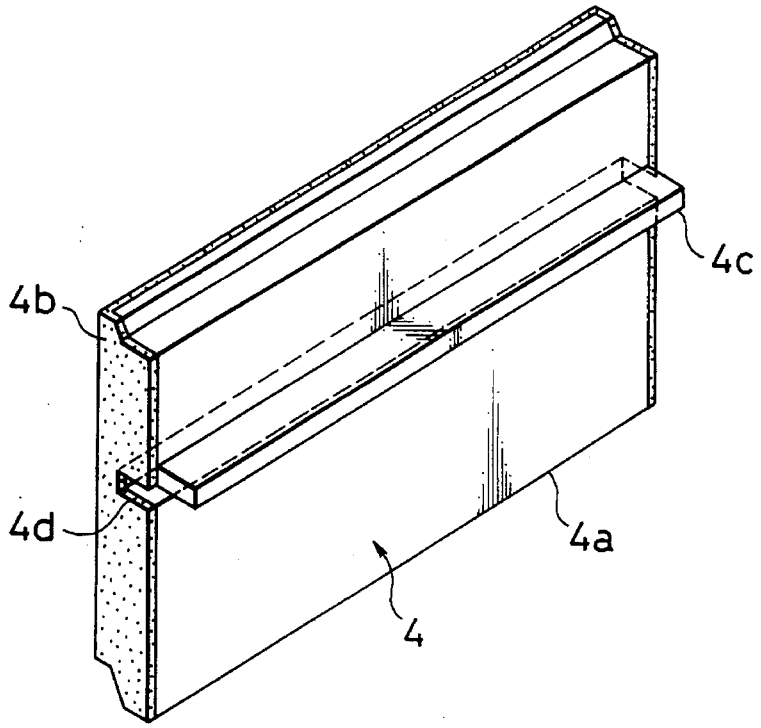
FIG. 1A is a perspective view exemplifying a face member according to the present invention.
Figure 4:
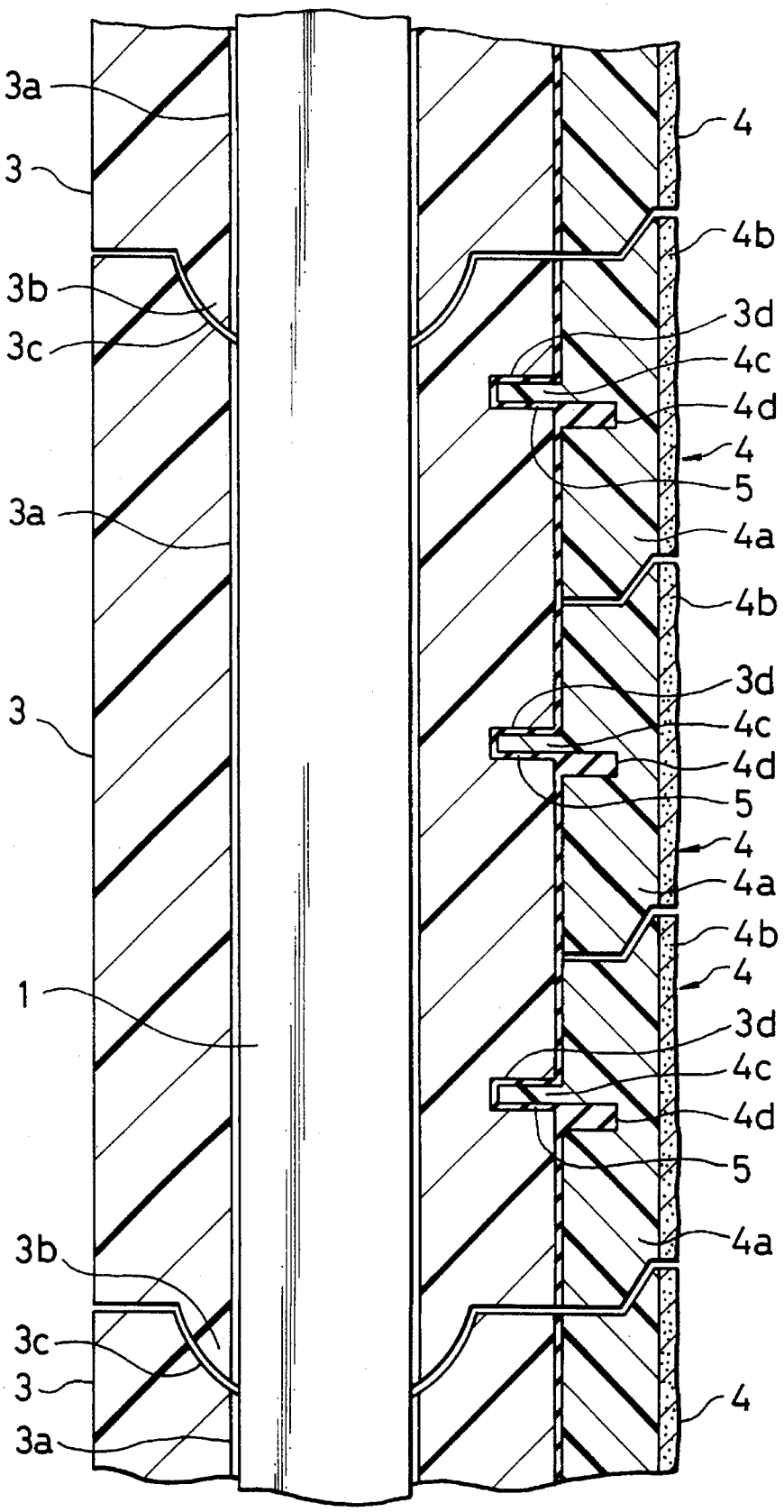
FIG. 4 is a vertical cross-sectional view of an architectural panel according to this embodiment.

As shown in FIGS. 1A and 4, the face member 4 has a base 4*a* and a top layer 4*b*. The base 4*a* is made of a synthesized resin foam member, and the top layer 4*b* is formed by a dried uniform coat of a mixture of an incombustible powdery material, such as sand or gravel, and an incombustible, weather-resistive synthesized resin adhesive. Accordingly, the top layer 4*b* has a stony finish. A projection (Weir-shaped projection) 4*c* having substantially the same height as the depth of the groove 3*d* formed in the bed 3 is formed horizontally on the back of the face member 4. A groove 4*d* is formed in the back of the face member 4, in parallel to and adjacent to the projection 4*c*. The groove 4*d* has substantially the same depth as the height of the projection 4*c* and is slightly wider than the projection 4*c*.

In building this fence, first, the through hole 3*a* of the bed 3 is fitted on the support 1 secured to the sill 2, as shown in FIGS. 2 and 4. Next, the projection 3*b* at the bottom of an upwardly adjoining bed 3 is fitted in the recess 3*c* at the top of the lower bed 3 so that both beds 3 are properly positioned and placed one on the other. Then, the projection 4*c* of the face member 4 is fitted and adhered into the groove 3*d* of the surface of the bed 3 by an adhesive 5. FIG. 2 shows the face member 4 adhered only to a part of the bed 3. In this example, a total of six face members 4 are attached to a single bed 3, in two rows horizontally with three face members 4 arranged in the vertical direction in each row. The correlation between the quantities of the bed 3 and the face members 4 may however be changed in various ways; for example, a single face member 4 may be attached to a single bed 3. In adhering the face member 4 to the bed 3 by the adhesive 5, the groove 4*d* in the face member 4 holds the adhesive 5, thus preventing the downward flow of the adhesive 5. The top of the support 1 may be designed to protrude above the bed 3, so that another member, such as coping or mesh fence, can be attached to the protruding portion to build a fence.

Figure 1B:
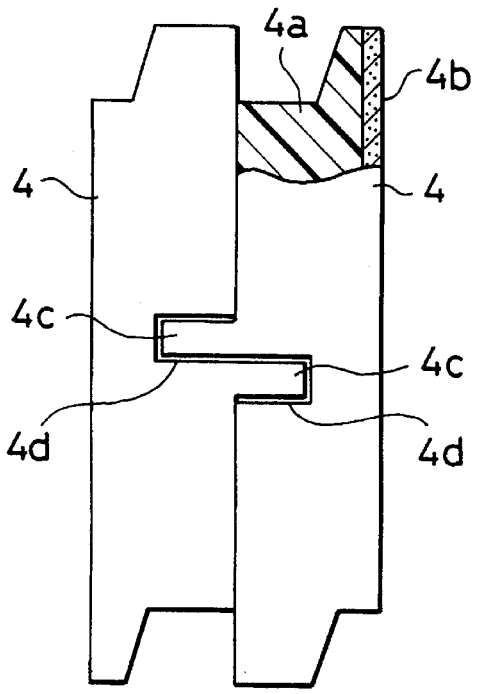
FIG. 1B is a side view showing two face members of this example combined together.

The face members 4 are joined with the projections 4*c* protected therebetween by fitting the projection 4*c* of one face member 4 into the groove 4*d* of the mating face member 4, as shown in Fig. 1B. Accordingly, the projections 4*c* are protected and prevented from being broken during transportation. Sand, gravel or the like are adhered on the top layer 4*b* of the face member 4 by an adhesive, yielding the stony-finished face member 4, and the bed 3 is covered with those face members 4 so that the face members 4, though being light, have an increased strength. The bed 3 and the face member 4, if made of a foam member to reduce their weights as in this embodiment, facilitate the construction and transportation of the architectural panel. Further, even if the bed 3 is broken down and falls on a pedestrian at the time of an earthquake, the pedestrian is less likely to be injured.

Figure 5:
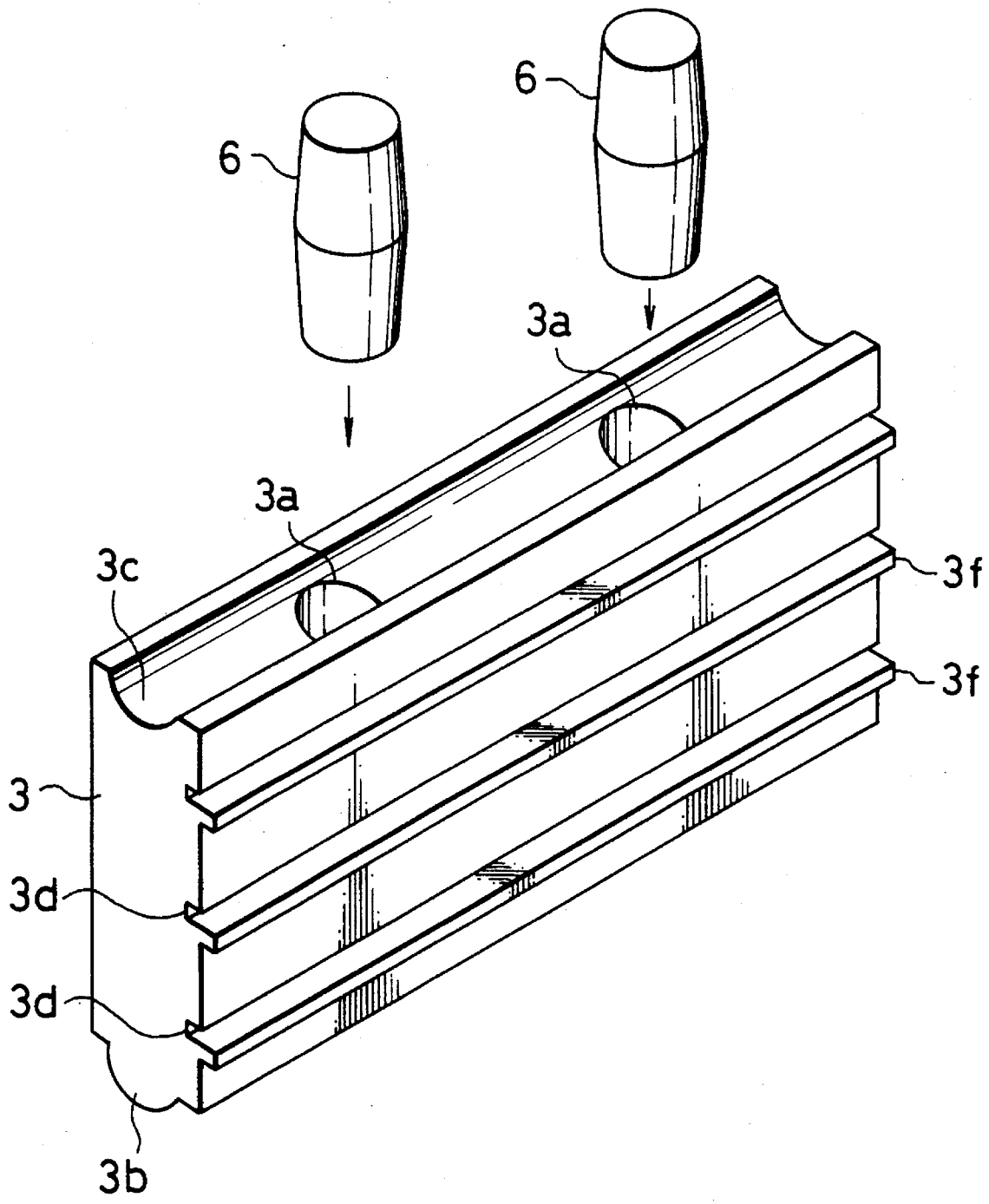
FIG. 5 is a perspective view showing another example of the bed and bed coupling means.
Figure 6:
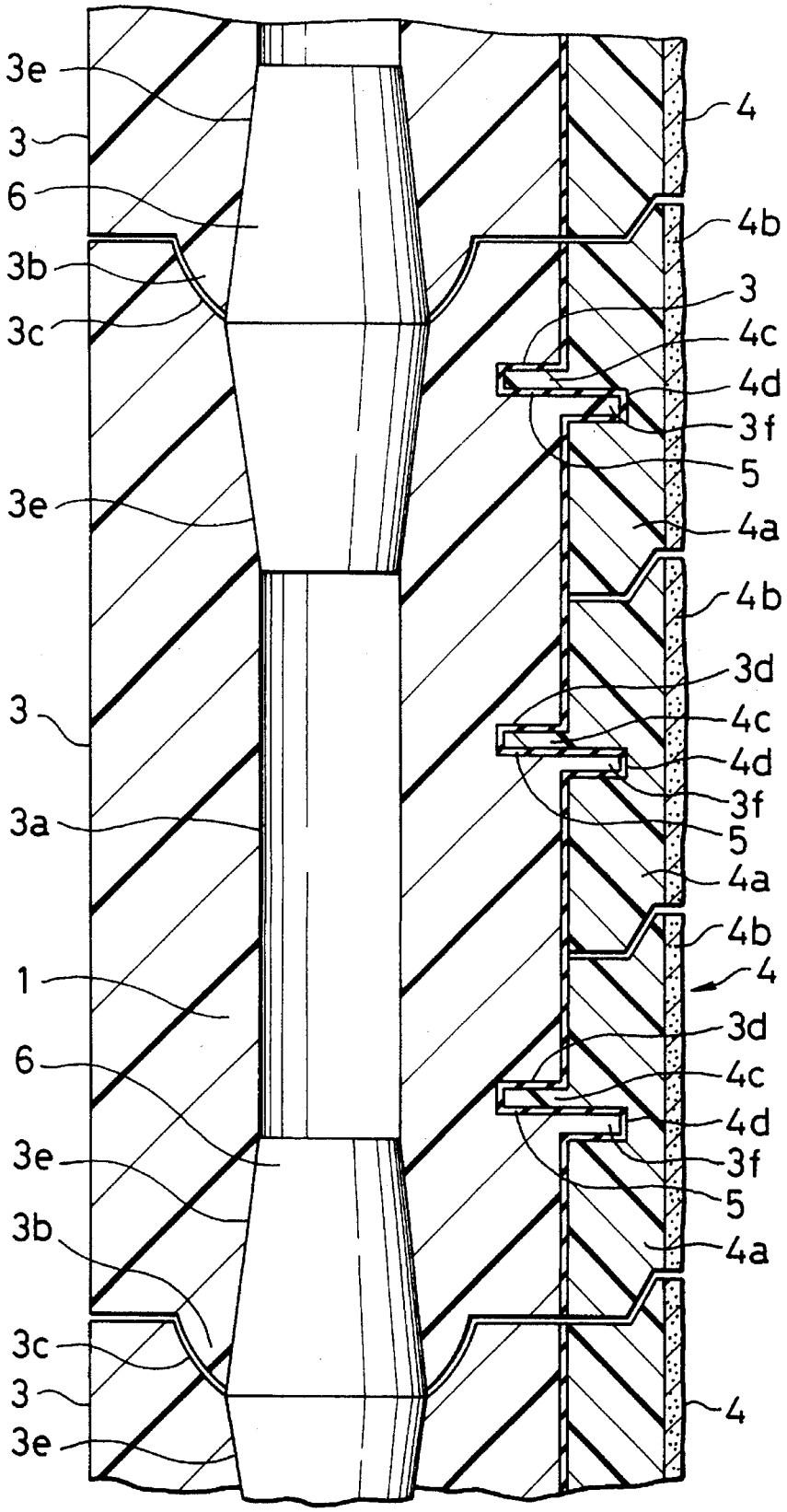
FIG. 6 is a vertical cross-sectional view showing one example of a fence which uses the bed and coupling means of this invention.

In the example shown in FIGS. 5 and 6, a coupling member 6 of a foam member, which becomes thinner toward the top and bottom ends to have a tapered shape, is fitted in the through holes of vertically adjoining beds 3 to connect those beds 3. The beds 3 are joined in this manner to build a fence. The through hole 3*a* has tapered top and bottom ends 3*e* to match with the taper shape of the coupling member 6. This example has such an advantage that the support 1 should not necessarily be provided so that a fence is built easily and at a low cost. In this example, one side or the other side of the through hole 3*a* or the coupling member 6 may be designed to have a polygonal or elliptical cross section.

In the example shown in FIGS. 5 and 6, the projection 4*c* of the face member 4 is fitted in the groove 3*d* provided in the bed 3 and the groove 4*d* of the face member 4 is fitted and adhered onto a projection 3*f* provided on the bed 3 by the adhesive 5, thereby enhancing the bonding strength of the face member 4. With the projection 3*f* provided on the bed 3, the fitting of this projection 3*f* into the groove 4*d* may serve to position the face member 4 or enhance the coupling strength, while the projection 4*c* of the face member 4 may be loosely fitted in the groove 3*d* of the bed 3.

Figure 7:
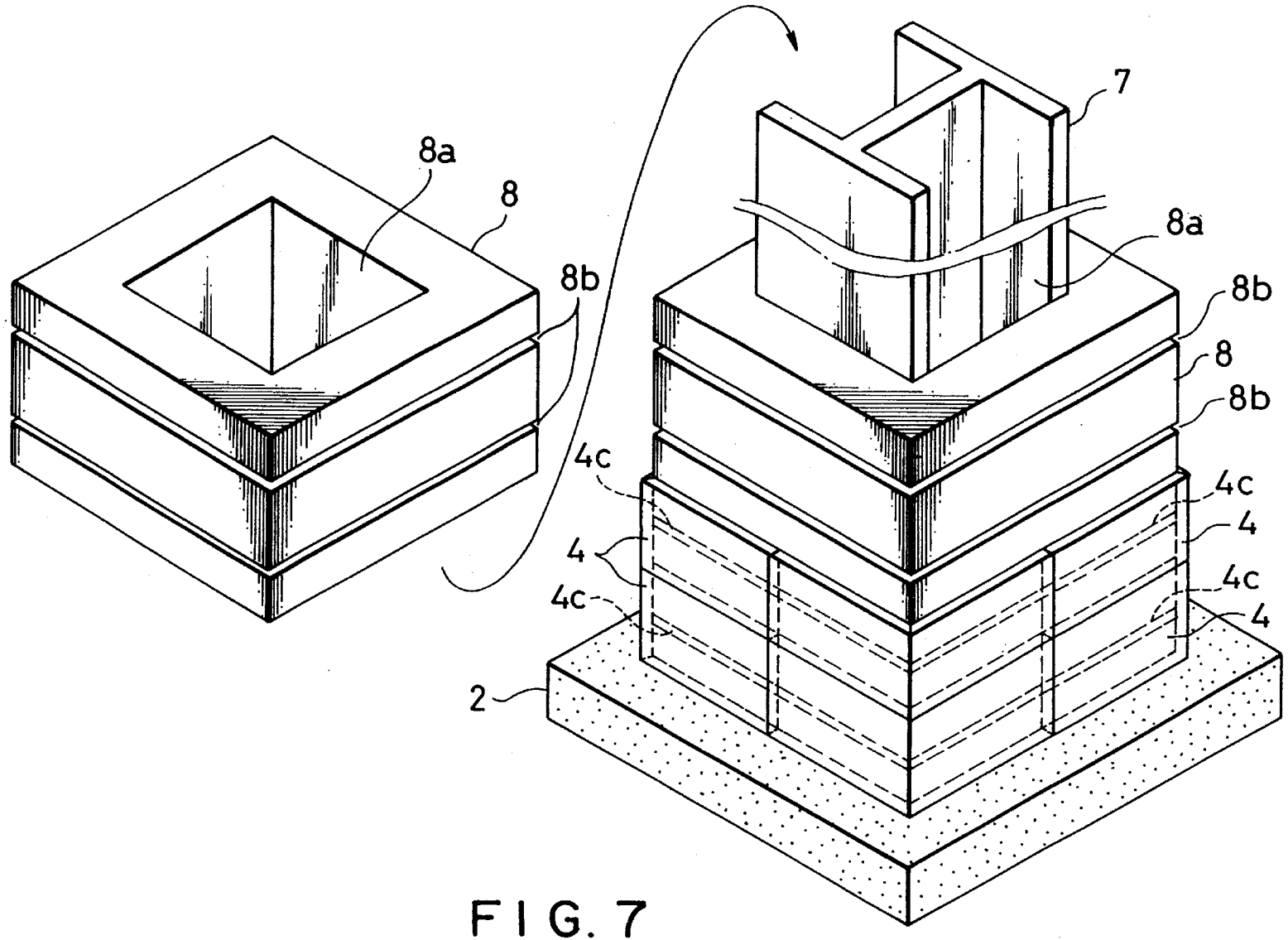
FIG. 7 is a perspective view showing this invention as adapted for a gate post.

FIG. 7 shows an example wherein a gate is built. In building this gate, first, a support 7 made of an aluminum alloy extruded section is secured to the sill 2. A bed 8 made of a foam member is attached to the support 7 by fitting its hole 8*a* over the support 7. Then, the projection 4*c* of the face member 4 is fitted in a groove 8*b* provided in the outer surface of the bed 8 and is secured to the groove 8*b* by an adhesive. In this example, the beds 8 are fitted over the support 7 one on another, facilitating the construction, and the beds 8 are supported by the support 7 to be prevented from being shifted. Further, the built gate has an enhanced strength.

Figure 8:
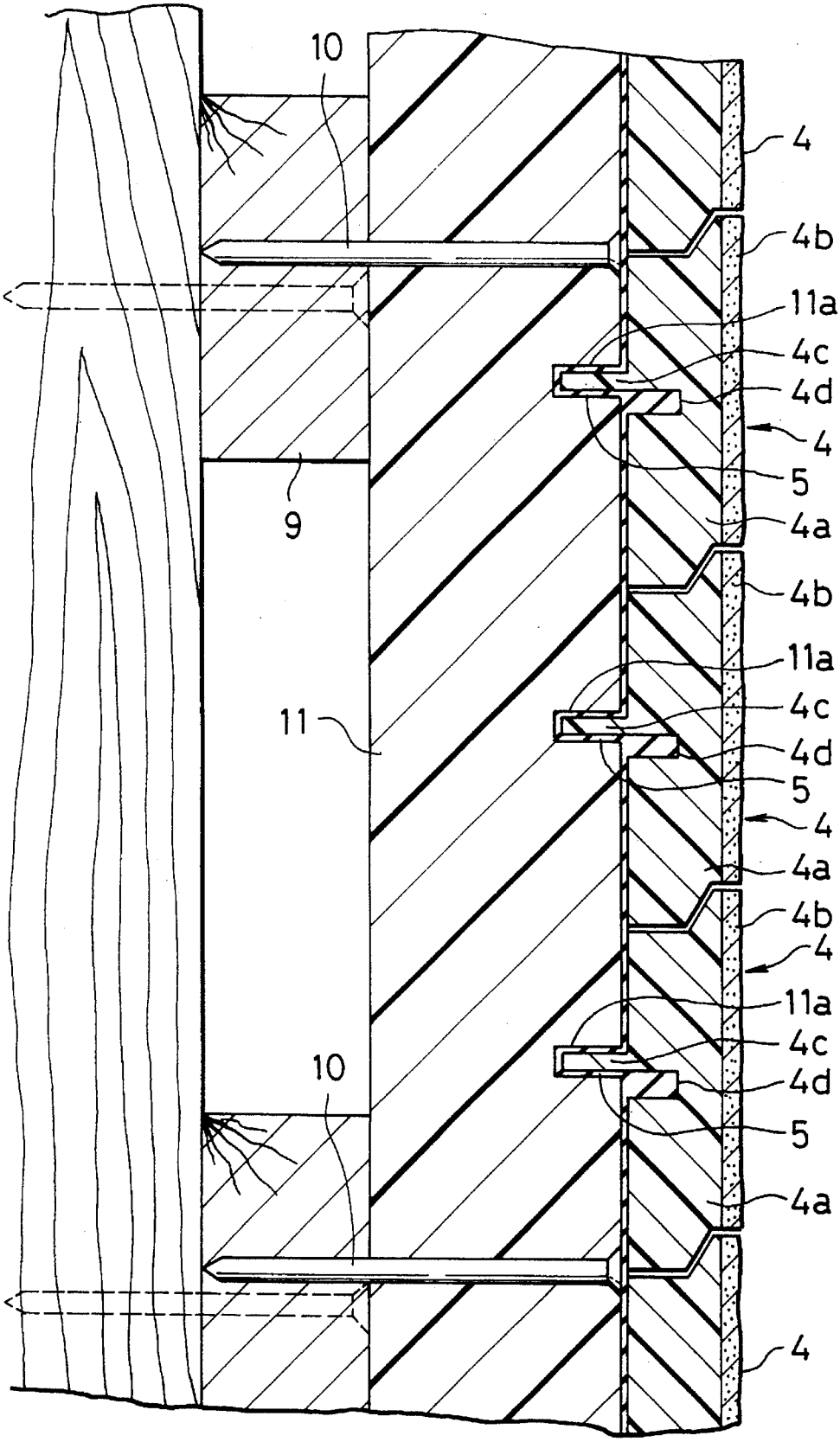
FIG. 8 is a vertical cross-sectional view showing this invention as adapted for the wall of a building.

FIG. 8 shows an example in which the wall of a building is constructed by the panels of this invention. In this example, a bed 11 made of a foam member or the like is attached to a stud 9 by a securing member 10 or an adhesive and the projection 4*c* of the face member 4 is fitted and secured in a groove 11*a* of the bed 11 by the adhesive 5 so that the bed 11 and the face member 4 are attached together.

As another example, a groove may be formed in a concrete block already placed in position so that the projection 4*c* of the face member 4 can be securely fitted in that groove. The face members 4 of this invention may be attached to such existing concrete blocks to build a fence. The specific shapes of the bed 3 and the face member 4 and the attachment therebetween are not limited to the illustrated ones and may be modified in various other forms. For example, two or more projections 4*c* may be provided in the face member 4 and two or more grooves 4*d* may be formed in the face member 4. The ends of the beds 3 may be butted against each other at right angles or in an inclined manner.

What is claimed is:

1. An architectural panel comprising:

a plurality of face members;

each said face member having a linearly extending projection and a linearly extending groove formed along a back surface thereof, said projection and groove lying parallel to each other entirely across said face member;

each said groove having substantially the same depth from said back surface as the height of said projection from said back surface and a width wider than a width of said projection;

a bed having grooves formed along a front surface thereof;

each face member being fixed to said bed by fitting said projection at said back surface thereof into one of said grooves formed in said front surface of said bed; and an adhesive applied to said grooves of said bed and said grooves of said face members such that said bed and said face members are secured to one another with said back surfaces of said face members abutting said front surface of said bed.

2. The architectural panel according to claim 1, wherein each said face member has a base made of a synthesized resin foam member and a mixture of an incombustible powdery material and an incombustible adhesive is coated on a front surface of said base of said face member to provide a stony finish.

3. The architectural panel according to claim 1, wherein said bed is made of a synthesized resin foam member.

4. The architectural panel according to claim 2, wherein said bed is made of a synthesized resin foam member.

5. The architectural panel according to claim 3, wherein a through hole is formed in said bed and a support formed of an aluminum alloy extruded shape, said through hole being fitted over said support to attach said bed to said support.

6. The architectural panel according to claim 3, including a plurality of beds, each bed having holes formed in top and bottom portions thereof, said beds being superposed over one another with vertically adjoining beds coupled by coupling members received in said holes, respectively, in said superposed beds.

7. The architectural panel according to claim 4, wherein a through hole is formed in said bed and a support formed of an aluminum alloy extruded shape, said through hole being fitted over said support to attach said bed to said support.

8. The architectural panel according to claim 4, including a plurality of beds, each bed having holes formed in top and bottom portions thereof, said beds being superposed over one another with vertically adjoining beds coupled by coupling members received in said holes, respectively, in said superposed beds.

9. The architectural panel according to claim 6 wherein said holes are tapered and each coupling member is tapered complementary to the taper of said hole for securing superposed beds to one another.

10. An architectural panel according to claim 1 wherein said bed has a plurality of linearly extending projections formed along said front surface thereof, said face members being fixed to said bed with said projections from said front surface of said bed being received in the linearly extending grooves formed along the back surfaces of said face members, said adhesive being applied between the grooves of said face members and said projections of said bed to adhere the face members and bed to one another.

* * * * *

UNITED STATES PATENT AND TRADEMARK OFFICE

CERTIFICATE OF CORRECTION

PATENT NO. : 5,566,517
DATED : October 22, 1996
INVENTOR(S) : MIKIO ISHII; SHIGERU MORI

It is certified that error appears in the above-identified patent and that said letters patent is hereby corrected as shown below:

On title page, item [73] should read:

--TOYO EXTERIOR CO., LTD.--

Signed and Sealed this

Twenty-fourth Day of June, 1997

Bruce Lehman

*Attest:*

BRUCE LEHMAN

*Attesting Officer*

*Commissioner of Patents and Trademarks*